US007252625B1

(12) United States Patent
Perka

(10) Patent No.: US 7,252,625 B1
(45) Date of Patent: Aug. 7, 2007

(54) TORSO ARCH SUPPORT FOR USE IN AQUATIC SPORTS

(76) Inventor: David J. Perka, 316 S. Miraleste Dr., Suite #106, San Pedro, CA (US) 90732

( * ) Notice: Subject to any disclaimer, the term of this patent is extended or adjusted under 35 U.S.C. 154(b) by 0 days.

(21) Appl. No.: 11/432,454

(22) Filed: May 11, 2006

Related U.S. Application Data

(63) Continuation-in-part of application No. 11/001,963, filed on Nov. 30, 2004, now abandoned.

(60) Provisional application No. 60/557,917, filed on Apr. 1, 2004, provisional application No. 60/526,287, filed on Dec. 3, 2003.

(51) Int. Cl.
*A63B 31/00* (2006.01)

(52) U.S. Cl. ..... 482/55; 2/2.15; 2/2.16; 441/102; 441/103; D2/731; D2/732

(58) Field of Classification Search ..... 482/55; 434/254; 2/2.15, 2.16, 462, 463, 465; 441/65, 441/66, 102, 103, 105, 108, 113, 115, 117, 441/136; D2/731, 732, 853
See application file for complete search history.

(56) References Cited

U.S. PATENT DOCUMENTS

| | | | | |
|---|---|---|---|---|
| 977,065 | A | | 11/1910 | Berry |
| 1,657,866 | A | | 1/1928 | Mooney |
| 2,331,301 | A | | 10/1943 | Brown |
| 2,389,735 | A | | 11/1945 | Morner |
| 2,569,742 | A | | 10/1951 | Austin |
| 3,803,652 | A | * | 4/1974 | Uyehara ..... 441/66 |
| D255,056 | S | | 5/1980 | Parsons |
| 4,356,569 | A | * | 11/1982 | Sullivan ..... 2/2.5 |
| 5,168,576 | A | | 12/1992 | Krent et al. |
| 5,413,485 | A | | 5/1995 | Adee |
| 5,465,424 | A | | 11/1995 | Cudney et al. |
| 5,621,914 | A | | 4/1997 | Ramone et al. |
| 5,623,728 | A | | 4/1997 | Wagner |
| D380,286 | S | | 7/1997 | O'Neill |
| D381,489 | S | | 7/1997 | O'Neill |
| 5,937,447 | A | | 8/1999 | Howell |
| 6,035,453 | A | | 3/2000 | Cain |
| 6,112,327 | A | | 9/2000 | Shaffer |
| 6,182,299 | B1 | | 2/2001 | Chen |
| 6,408,440 | B1 | | 6/2002 | Phillips |
| 6,434,749 | B1 | | 8/2002 | Grounds et al. |
| 6,485,446 | B1 | | 11/2002 | Brother et al. |
| 6,678,899 | B2 | | 1/2004 | Fiorini et al. |
| D505,771 | S | | 6/2005 | Herman et al. |
| 6,862,751 | B1 | | 8/2005 | Wattenbarger et al. |
| 2006/0073943 | A1 | | 4/2006 | Perka |

* cited by examiner

*Primary Examiner*—Jerome Donnelly
*Assistant Examiner*—Tam Nguyen
(74) *Attorney, Agent, or Firm*—Peter Ganjian

(57) ABSTRACT

The present invention discloses a wetsuit that may be worn by a user for providing torso support when user is lying prone on a board while engaging in aquatic sports. The wetsuit includes a torso wedge, which is generally aligned proximal the width of a costal arch of the user lower rib cage, critical in supporting the torso of the user. In general, the torso wedge is configured to provide a wedge-like angle between the board and the user's chest when the user is in a prone position on the board, thereby elevating the torso of the user.

8 Claims, 15 Drawing Sheets

TORSO ARCH SUPPORT FOR USE IN AQUATIC SPORTS

CROSS-REFERENCE TO RELATED APPLICATIONS

This application claims the benefit of priority and is a Continuation-In-Part of the prior U.S. Utility Non-Provisional patent application Ser. No. 11/001,963, with a filing date of Nov. 30, 2004, now abandoned; which application (Ser. No. 11/001,963) claims the benefit of priority of U.S. Utility Provisional Patent Application No. 60/557,917, filed Apr. 1, 2004 and U.S. Utility Provisional Patent Application No. 60/526,287, filed Dec. 3, 2003, the entire disclosures of all applications are expressly incorporated by reference in their entirety herein.

BACKGROUND OF THE INVENTION (1) Field of the Invention

The present invention relates to the field of aquatic sports and, more particularly to aquatic attire that provides torso support for a user when in a prone position on a hard surface.

(2) Description of Related Art

In aquatic sports a variety of boards are used on which to lie or ride on when in water, non-limiting examples of which may include surfboards, kick boards, body boards, paddle boards, etc. As illustrated in the prior art FIG. 1, in using such boards, it is the customary practice for the user 100 to lie prone on his stomach along the upper surface of the board 102. The prone position of the user 100 on the board 102 causes the upper torso to rise above the surface of the board 102, with the torso solely supported by the skeletal frame, particularly, the back of the user 100. This causes a strain or fatiguing of the lumbar region as well as the thoracic and cervical spine due to the arch of the back, which is sustained for a relatively long time, causing chronic back pain, muscle tension, postural imbalance, and other physical problems.

Accordingly, a long-standing need has existed in aquatic sports that would provide an ergonomic means for torso support for a person in prone position, that would relax the lumbar and upper back muscles, increase blood flow circulation, and decrease relative discomfort in the upper and lower back by decreasing compression of skeletal facet joints, disks, and nerves, while supporting the abdomen and the pelvis regions of the torso.

BRIEF SUMMARY OF THE INVENTION

The present invention provides a wetsuit, comprising:

a torso wedge having a backside, a frontal section having top, middle, and bottom portions, and raised side-walls for torso support when worn in a prone position on a hard surface;

the backside of the torso wedge is concaved and commensurately contoured to absorb pressure from a curved middle section of a user in a prone position;

the frontal section of the torso wedge is elevated having a varying gradient that is reduced from top to bottom portions of the frontal section, and is further concaved throughout the gradient from top to bottom, and laterally, thereof;

the top portion of the frontal section of the torso wedge is comprised of an arched apex plateau that conforms, supports, and spans a proximal width of a costal arch of the user lower rib cage, elevating a torso of the user when in the prone position on the hard surface to reduce user upper and lower back exertion;

the middle portion of the frontal section of the torso wedge is lower in gradient than the top portion, with increased concavity in relation to the top portion for better distribution of the user mass across the hard surface;

the bottom portion of the frontal section of the torso wedge is lower in gradient than the middle portion, with decreasing concavity in relation to the middle portion for better distribution of abdominal mass of the user across the hard surface; and the side walls of the torso wedge are comprised of concaved, slanted edges having varying heights that vary commensurate with the gradient of the frontal section, with a side wall top integral with the arched apex plateau of the top portion.

One optional aspect of the present invention provides a wetsuit, wherein:

the torso wedge is coupled with the wetsuit by coupling a hem of the torso wedge with the wetsuit.

Another optional aspect of the present invention provides a wetsuit, wherein:

the hem of the torso wedge is comprised of a semicircle at the top portion, a reverse "V" arch configuration at the bottom portion, and angular slanting sides coupling the top portion with the bottom portion.

Yet another optional aspect of the present invention provides a wetsuit, wherein:

the torso wedge is comprised of a sole, single piece unit.

A further optional aspect of the present invention provides a wetsuit, wherein:

the torso wedge is comprised of a plurality of water and flexibility channels throughout the frontal section thereof.

Still a further optional aspect of the present invention provides a wetsuit, wherein:

the torso wedge is comprised of an Ethylene Vinyl Acetate (EVA) foam covered by a wetsuit composite comprised of neoprene.

Another optional aspect of the present invention provides a wetsuit, wherein:

the torso wedge is comprised of an Ethylene Vinyl Acetate (EVA) foam covered by a wetsuit composite comprised of Lycra.

Yet another optional aspect of the present invention provides a wetsuit, wherein:

the torso wedge is comprised of an Ethylene Vinyl Acetate (EVA) foam covered by a wetsuit composite comprised of neoprene and Lycra.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

This disclosure refers throughout to the terms "hard surface" or "board," which the present invention defines as any hard surface that is buoyant in water, and used in a variety of different aquatic sports or activities, non-limiting examples of which may include surfboards, kick boards, body boards, paddle boards, etc. In addition, this disclosure refers throughout to the term "wetsuit" which the present invention defines as a body suit (or vest), whereby in general, water absorbed by the body suit or vest is heated by the skin and provides an insulating layer.

Figure 1:
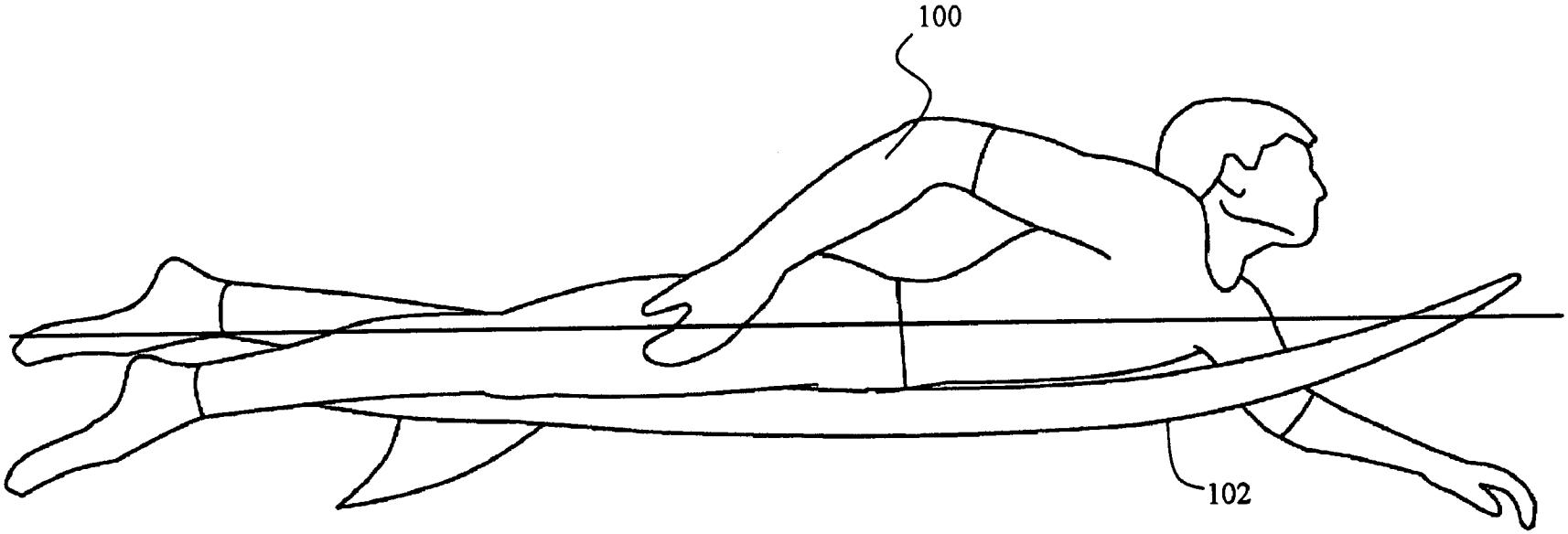
FIG. 1 (PRIOR ART)
FIG. 1 is an exemplary prior art illustration of a user in prone position on a board.
Figure 2:
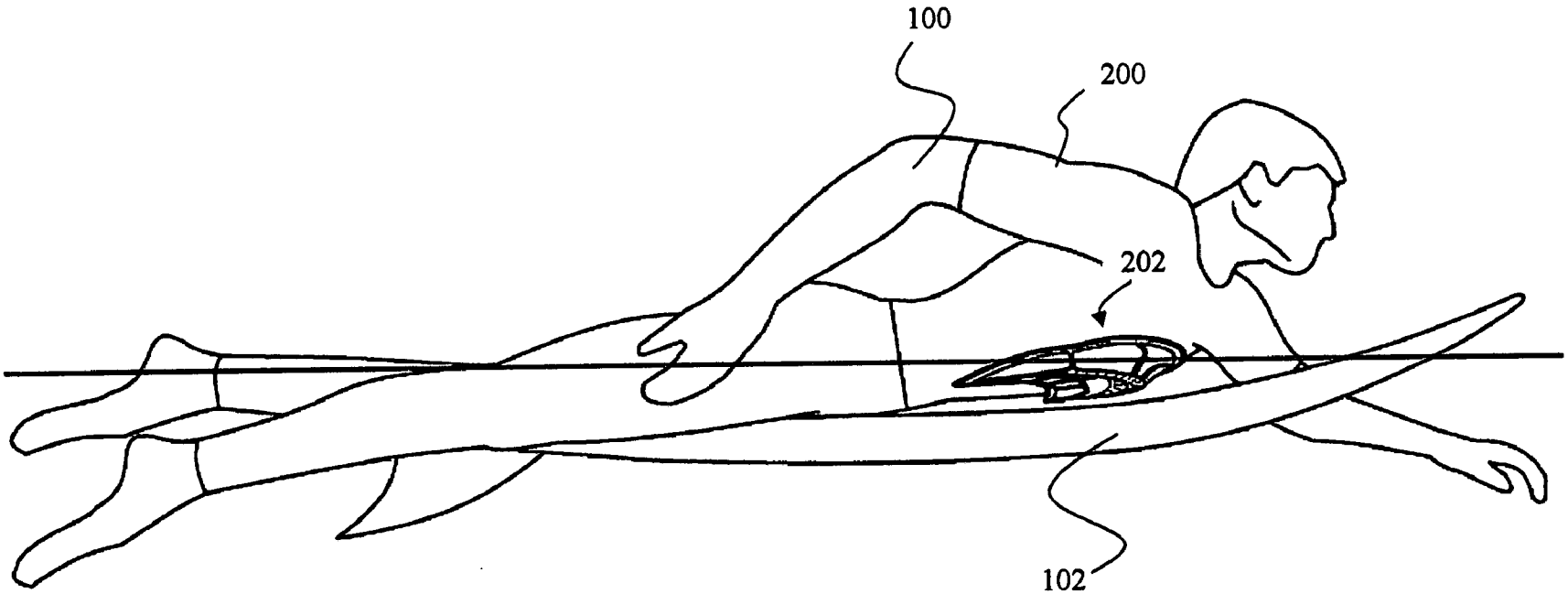
FIG. 2 is an exemplary illustration of a wetsuit worn by a user in a prone position on a board in accordance with the present invention.

As best illustrated in FIG. 2, the present invention provides a wetsuit 200 that may be worn by a user 100 for providing torso support when user 100 is lying prone on a board 102 while engaging in aquatic sports. The wetsuit 200 includes a torso wedge 202, which is generally aligned proximal the width of a costal arch of the user lower rib cage, critical in supporting the torso of the user 100. As illustrated, the torso wedge 202 is configured to provide a wedge-like angle between the board 102 and the user's chest when the user 100 is in a prone position on the board 102. In particular, during paddling (by hands to propel the board 102), the user's chest and abdomen are raised from the board 102, requiring the user to have a torso support, which support is provided by the torso wedge 202 of the present invention. Accordingly, the present invention provides an arch support for a user 100 when in prone position, which relieves tension on the upper and lower back, including shoulders and the neck of the user 100, improving the user average endurance and stamina for aquatic sports activities.

Figure 3:
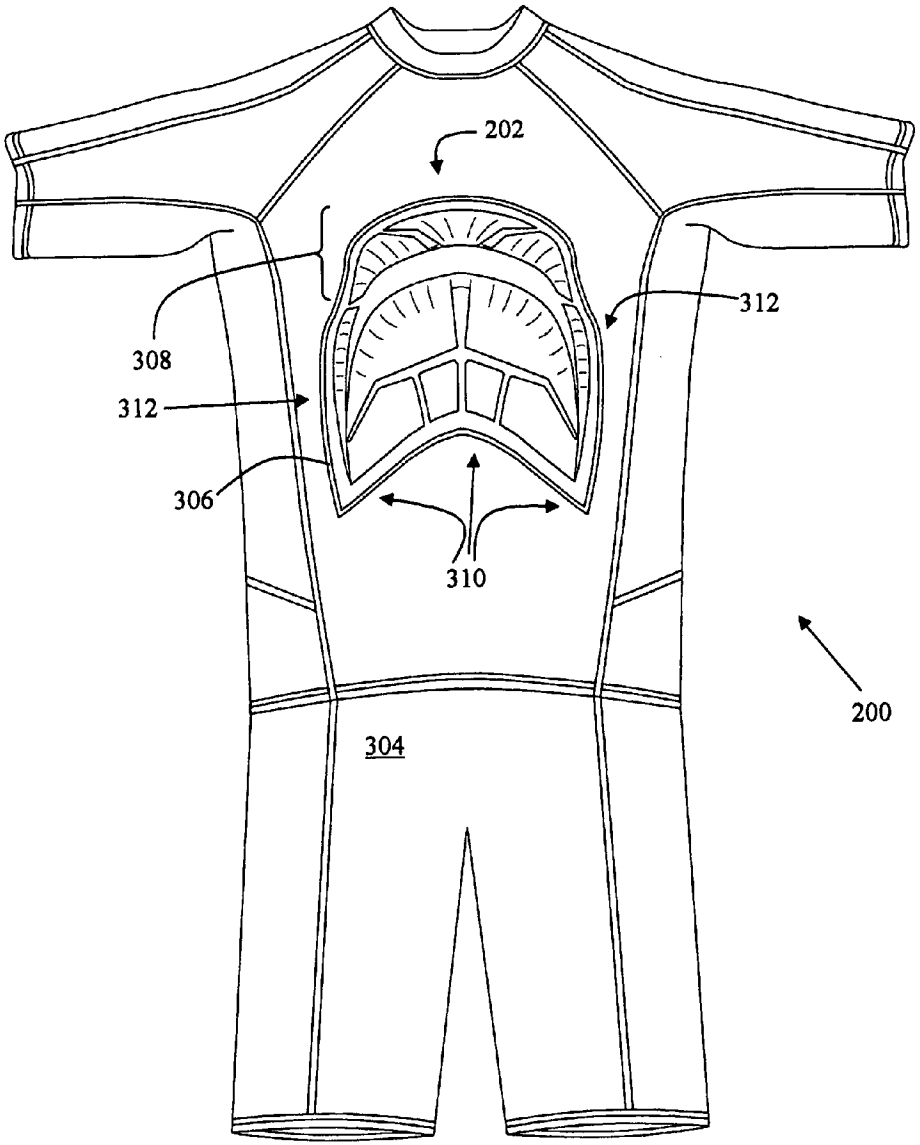
FIG. 3 is an exemplary plan view illustration of a wetsuit in accordance with the present invention.
Figure 4:
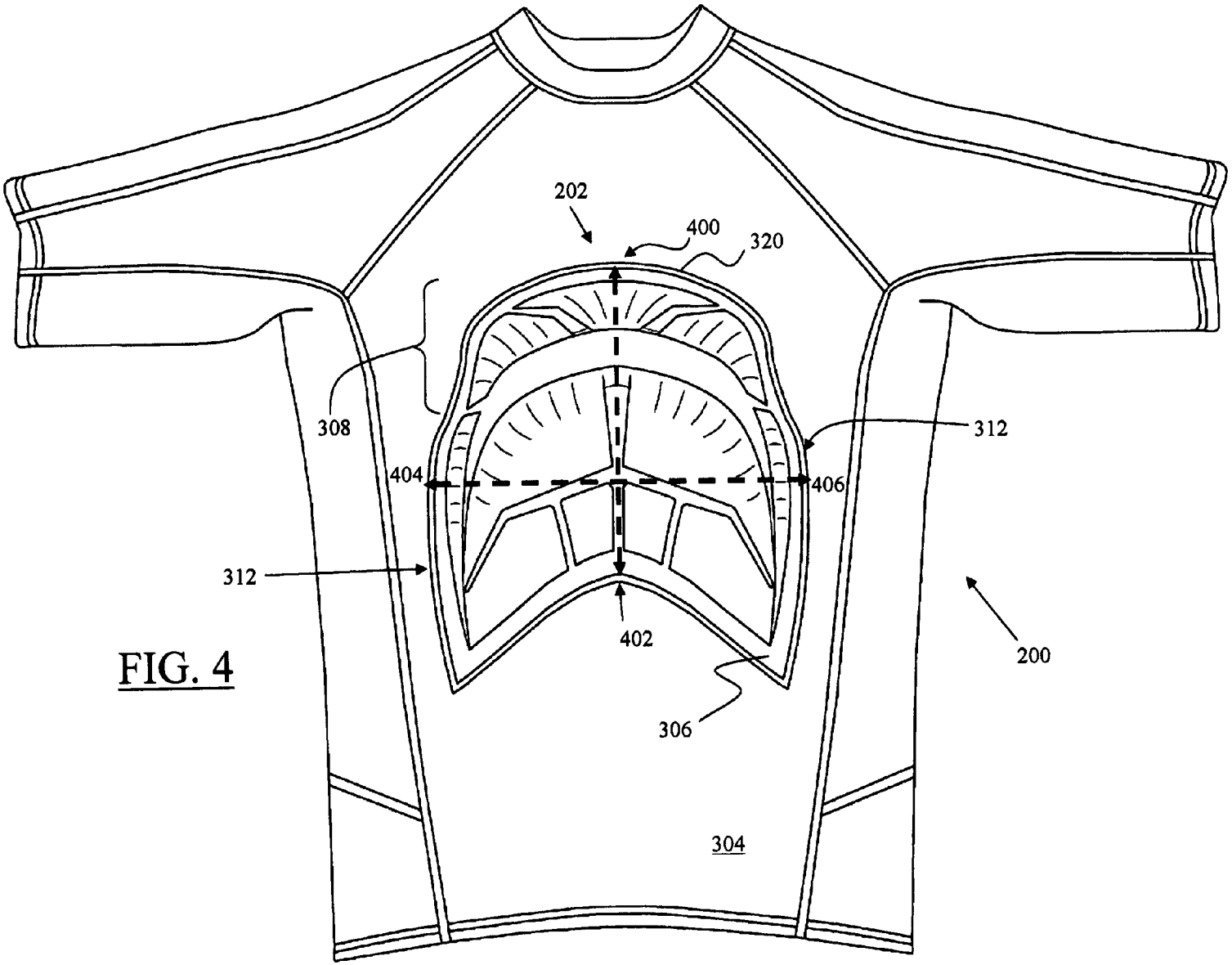
FIG. 4 is an exemplary plan view of the wetsuit illustrated in FIG. 3 in the form of a vest in accordance with the present invention.
Figure 5:
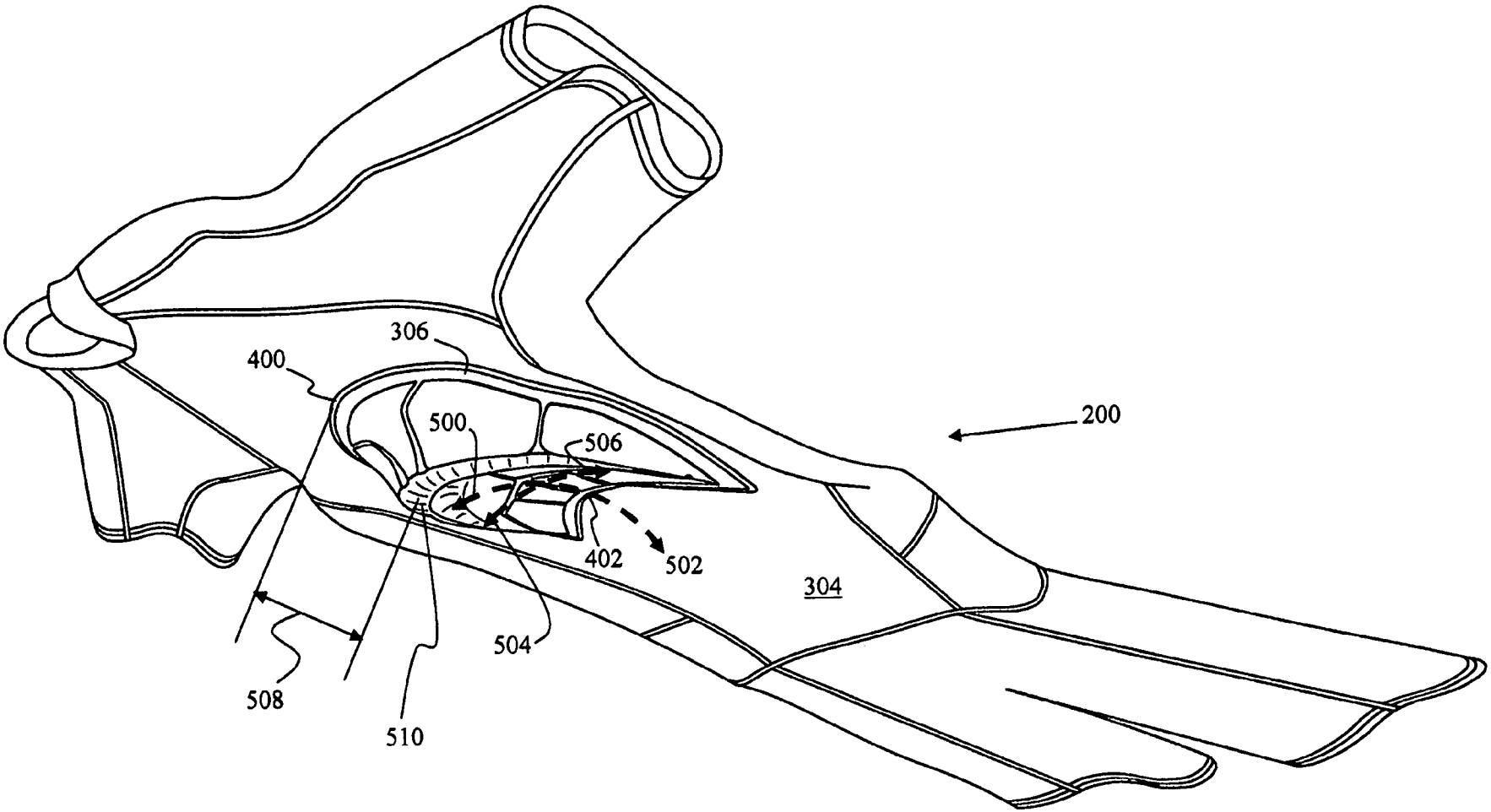
FIG. 5 is an exemplary perspective top view of the wetsuit illustrated in FIG. 3 in accordance with the present invention.
Figure 6:
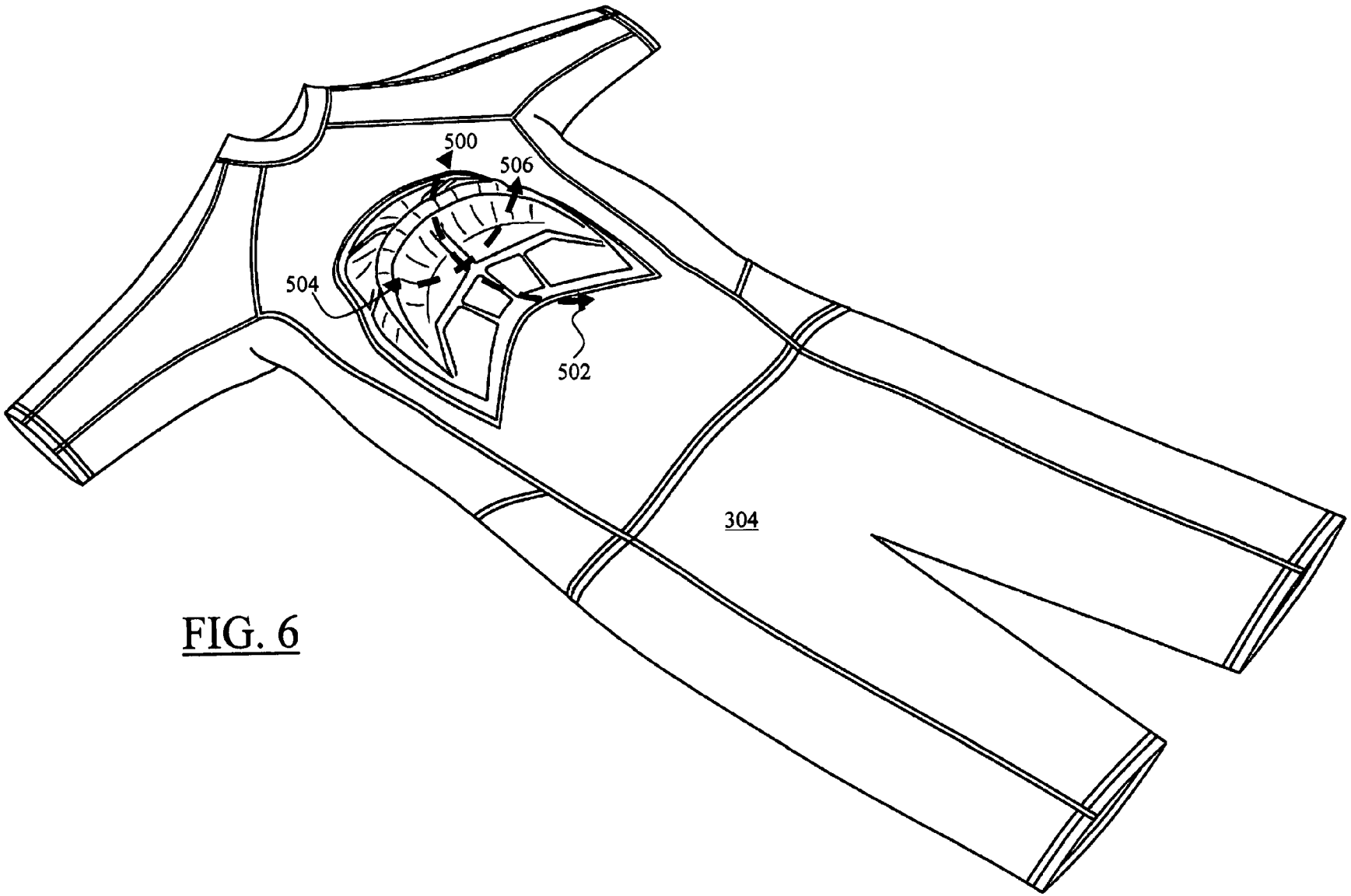
FIG. 6 is an exemplary perspective bottom view illustration of the wetsuit illustrated in FIG. 3 in accordance with the present invention.
Figure 7:
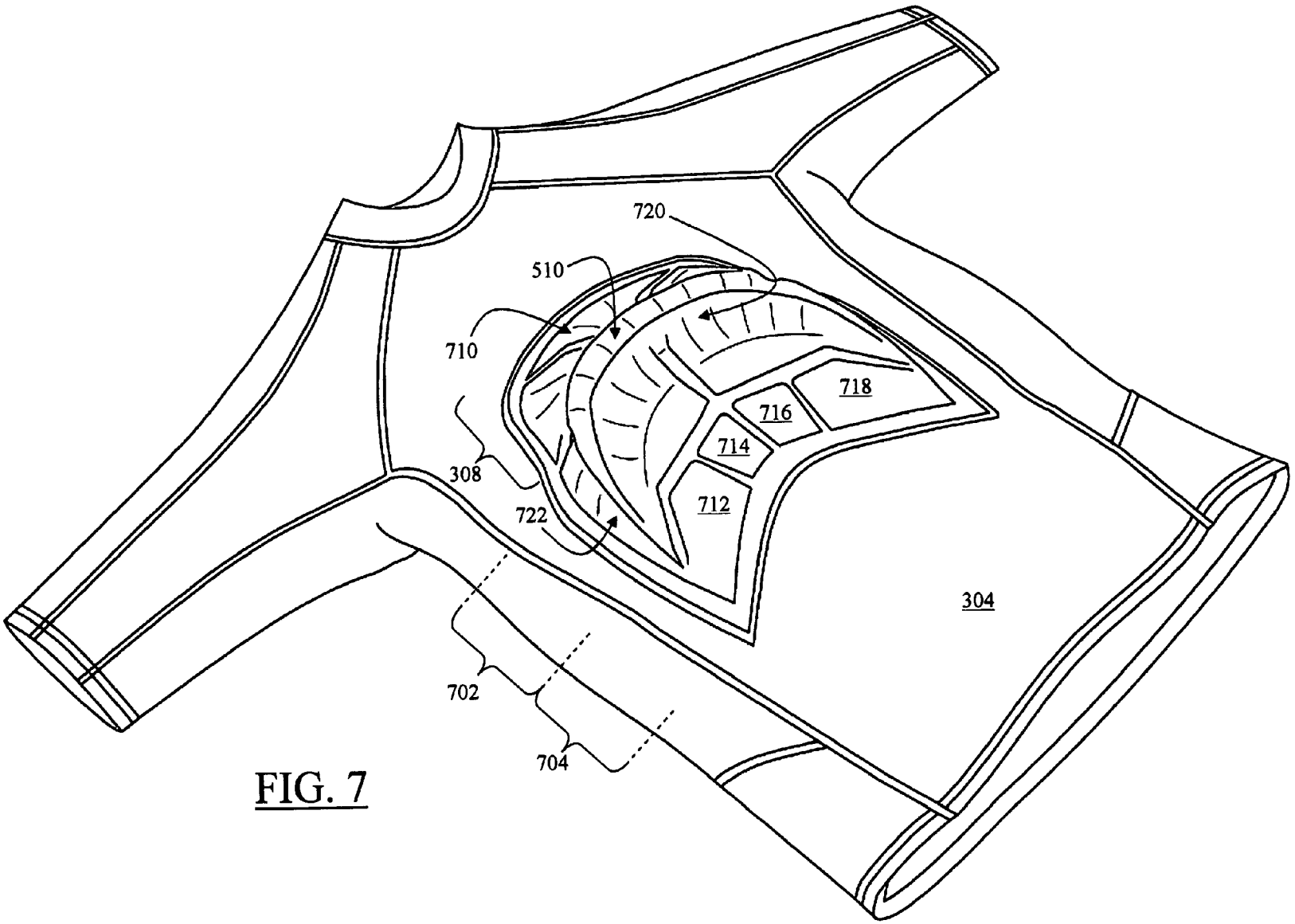
FIG. 7 is an exemplary perspective illustration of the wetsuit in the form of the vest illustrated in FIG. 4 in accordance with the present invention.
Figure 8:
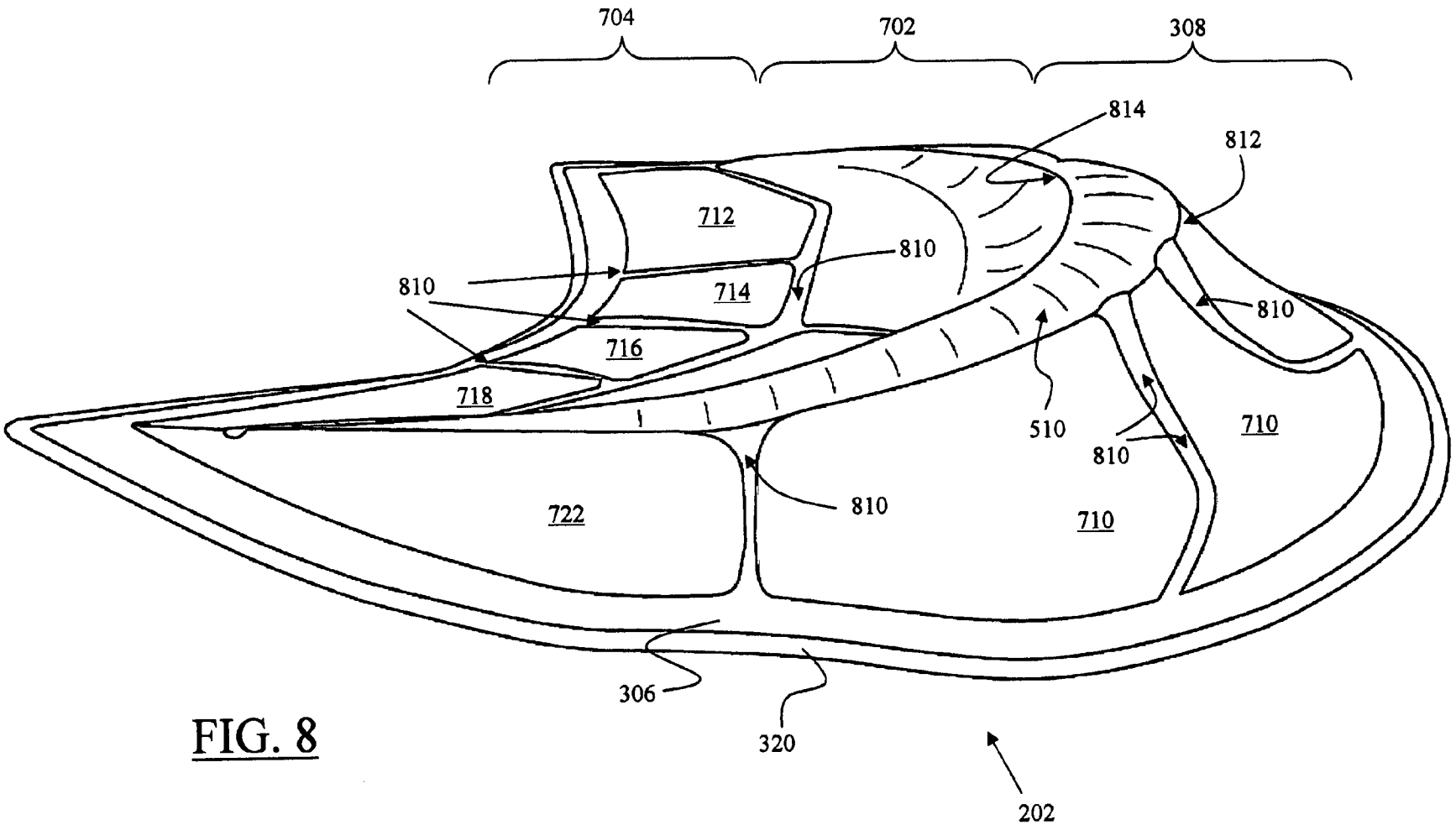
FIG. 8 is an exemplary side perspective illustration of the torso wedge in accordance with the present invention.
Figure 9:
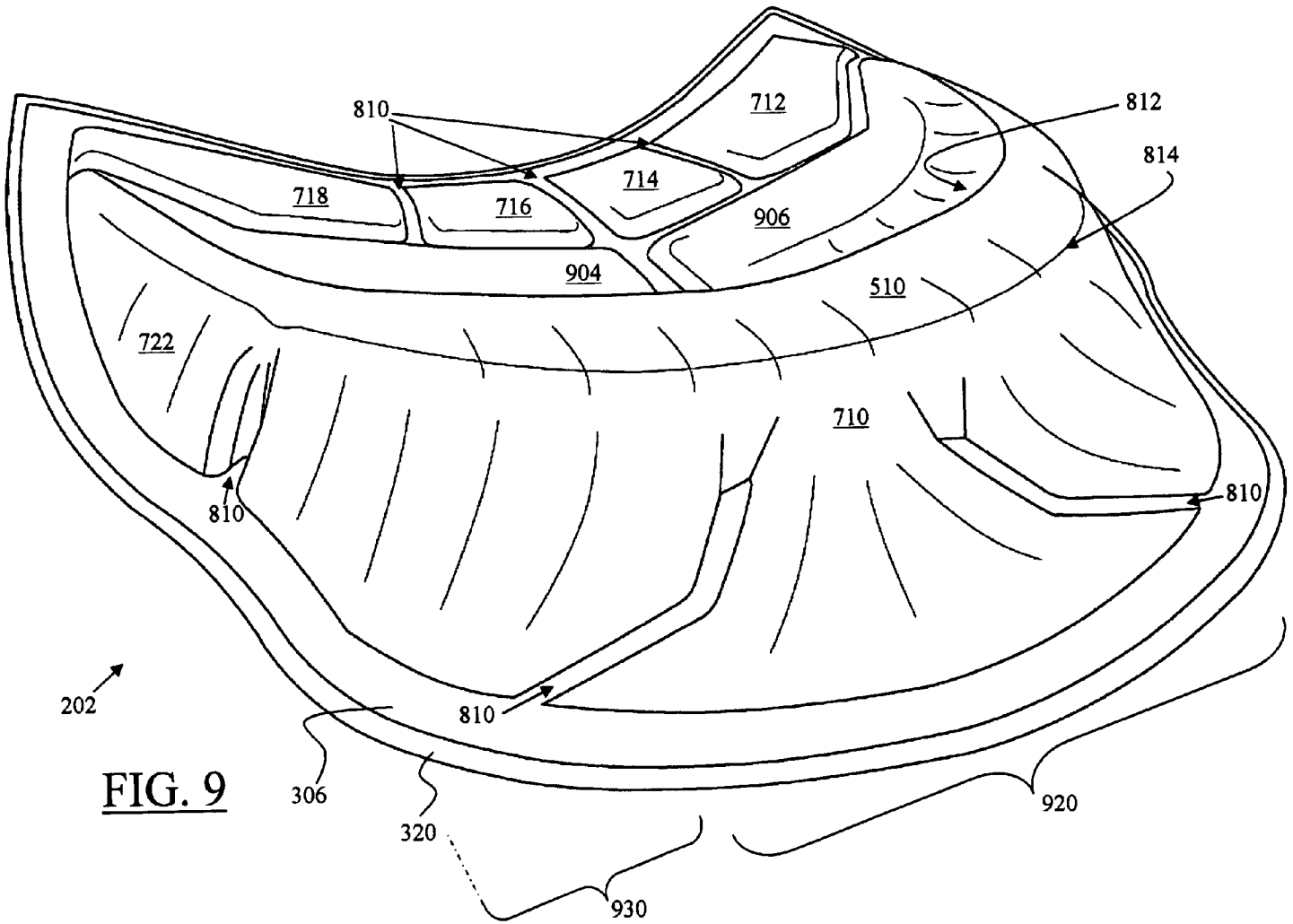
FIG. 9 is an exemplary front and side perspective illustration of the torso wedge in accordance with the present invention.

FIG. 3 is an exemplary plan view illustration of the wetsuit 200 in accordance with the present invention, and FIG. 4 is an exemplary plan view of the wetsuit 200 illustrated in FIG. 3 in the form of a vest. FIG. 5 is an exemplary perspective top view of the wetsuit 200 illustrated in FIG. 3, and FIG. 6 is an exemplary perspective bottom view illustration of the wetsuit 200 illustrated in FIG. 3. FIG. 7 is an exemplary perspective illustration of the wetsuit 200 in the form of the vest that is illustrated in FIG. 4.

Referring to FIGS. 3 to 7, the wetsuit 200 of the present invention is a body suit or vest that may or may not include sleeves (although sleeves are illustrated throughout the drawings). Further, the wetsuit 200 may or may not include full length legs. The wetsuit 200 includes a body portion 304 of lightweight flexible material that is generally made of neoprene rubber foam, Lycra, or a combination of neoprene and Lycra, or the like. The front part of the wetsuit 200 includes the torso wedge 202, which is preferably comprised of a sole, single piece unit made of resilient foam cushion material, a non-limiting example of which may include an Ethylene Vinyl Acetate (EVA) foam. Preferably, the torso wedge 202 may in general be covered by the same material as the body portion 304, and is coupled with the wetsuit 200 by coupling a hem 306 of the torso wedge 202 with the wetsuit 200. The hem 306 is comprised of a semicircle at the top portion of the torso wedge 202, which is generally indicated by the reference numeral 308, a reverse "V" arch configuration at the bottom portion of the torso wedge 202, which is generally indicated by the reference numeral 310, and angular slanting sides 312 that couple the top portion 308 with the bottom portion 310.

As further illustrated in FIGS. 3 to 6, the torso wedge 202 is arranged so to generally rest against and align with the chest and the general torso section of the user. The vertical length from the center top of the torso wedge 202 to the center bottom indicated by the dashed line 400-402 is approximately about 9½ inches, and the central horizontal lateral length indicated by the dashed line 404-406 is approximately about 9½ inches. As best illustrated in FIG. 5, the top center at 400 (along the hem 306) is generally aligned less than a few inches, indicated by the reference 508, above the costal arch of the user lower rib cage, and the bottom center at 402 is generally on the abdomen of the user. The top center at 400 being a few inches above the costal arch of the user lower rib cage allows an arched apex plateau of the main support 510 of the torso wedge 202 to align, span, and rest against a proximal width and length of a costal arch of the user lower rib cage, elevating a torso of the user 100 when in the prone position on the hard surface to reduce user upper and lower back exertion. The center lateral length 404-406 spans transverse the front, covering the user front section laterally. The center vertical length 400-402 and the center horizontal lateral length 404-406 can easily be varied to accommodate different users' sizes for an appropriate and effective torso support. As further illustrated in FIGS. 5 to 6, the front top portion 308 of the torso wedge 202 is elevated, but has a varying gradient that is reduced from top to bottom portions of the frontal section. Further, the lateral edges of the torso wedge 202 have varying gradient, that are reduced from each lateral side towards the center line 400-402. In addition, the torso wedge 202 is concaved throughout the gradients from top to bottom 500-502, and laterally 504-506, thereof.

Figure 10:
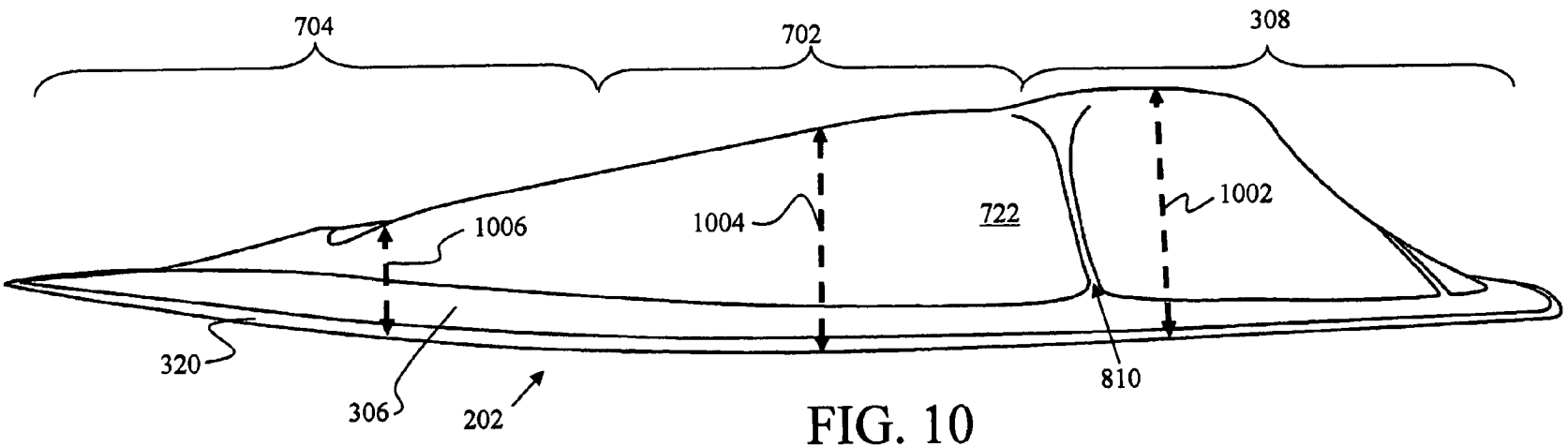
FIG. 10 is an exemplary side view illustration of the torso wedge in accordance with the present invention.

FIGS. 7 to 11 are exemplary detailed illustration of the torso wedge 202, showing the various views thereof. The torso wedge 202 is comprised of a frontal section having a top 308, middle 702, and bottom 704 portions, and raised lateral side-walls 722, and a fore wall 710 for torso support when the wetsuit 200 is worn in prone position on a hard surface or a board 102. As best illustrated in FIG. 10, the top portion 308 of the frontal section of the torso wedge 202 is elevated to a height 1002 of approximately one inch at a minimum, having a gradient that is reduced from top 308 to bottom 704 portions of the frontal section, and is further concaved throughout the gradient from top to bottom 500-502, and laterally 504-506, thereof, as indicated in FIGS. 5 to 6. The height 1004 of the middle portion 702 is less than the height 1002 of the top portion 308, but greater than the height 1006 of the bottom portion 704. Hence, the torso wedge 202 has varying thickness, and is configured to have an upper portion having thickness that lifts and elevates the torso of the user 100, and a lower portion with thickness that is less than the thickness of the upper portion for supporting the mass of the user.

Referring back to FIGS. 7 to 9, the top portion 308 of the frontal section of the torso wedge 202 is comprised of the arched apex plateau of the main support 510 that is substantially crescent shape, which conforms, supports, and spans a proximal length of a costal arch of the user lower rib cage. The main support 510 elevates a torso of the user 100 to a height 1002 when in the prone position on the hard surface to reduce user upper and lower back exertion. Given varying thickness of the torso wedge 202, the main support 510 is actually substantially lower in height near the bottom portion 704, proximal the protuberances 712 and 718 of the torso wedge 202, and acclivous towards the center 400 of the top portion 308 (at the fore section 920 of the torso wedge 202).

The top portion 308 further includes the fore wall 710, exterior the respective vertical and lateral incurvate 500-502 and 504-506. The fore wall 710 is concaved, and is slanted, sloping upward from the hem 306 towards the arched main support 510, forming the apex plateau. The fore wall 710 has a vertical slope, proximal the section generally indicated by the reference 812, near the plateau of the main support 510. Lengthwise, the fore wall 710, and the vertical sloping sections 812 are substantially crescent shaped, following along the shape of the main support 510, with height of the fore wall 710 varying commensurate with the gradient of the frontal section. That is, the climax of the fore wall 710 is at the fore section 920 (proximal the vertical center 400), which forms the apex of the main support 510, and is reduced moving towards the lateral walls 722, proximal the sides sections 930. As further illustrated, the fore wall 710 further includes a plurality of grooves or channels 810 for providing flexibility for the torso wedge 202 when under the weight of the user 100, and further function as conduits for removal of water.

The middle portion 702 of the frontal section of the torso wedge 202 is lower in gradient than the top portion 308, with increased concavity (vertical 500-502 and lateral 504-506) in relation to the top portion 308 for better distribution of the user mass across the board 102. The lateral sections of middle portion 702 of the frontal section of the torso wedge 202 includes the lower sections of the arched main support 510, which has a height that is lower than the apex at the top portion 308, and continues to vary commensurate with the gradient of the frontal section.

The middle portion 702 has a general slight rise, and includes one or more middle protuberances 904 and 906 that are laterally separated by grooves or channels 810, forming a cushion of support between a user 100 and the board 102. The protuberances 904 and 906 acclivate towards the plateau of the main support 510, which form an interior fore wall 720. The interior fore wall 720 is concaved, and is slanted, sloping upward from the middle protuberances 904 and 906 towards the arched main support 510, forming the apex plateau at the fore section 920. The interior fore wall 720 has a vertical slope, proximal the section generally indicated by the reference 814, near the plateau of the main support 510. Hence, the two vertical sections 812 and 814 in combination with the plateau of the main support 510 form a cross-section, which has an approximate square configuration.

Lengthwise, the interior fore wall 720, and the vertical sloping sections 814 are substantially crescent shaped, following along the shape of the main support 510, with height of the interior fore wall 720 varying commensurate with the gradient of the frontal section. That is, the climax of the interior fore wall 720 is at the fore section 920 (proximal the vertical center 400), which forms the apex of the main support 510, and is reduced moving towards the lateral walls 722 and the middle protuberances 904 and 906, proximal the center and side sections 930. As further illustrated, the interior fore wall 720 further includes a plurality of grooves or channels 810 for providing flexibility for the torso wedge 202 when under the weight of the user 100, and further function as conduits for removal of water.

Figure 11:
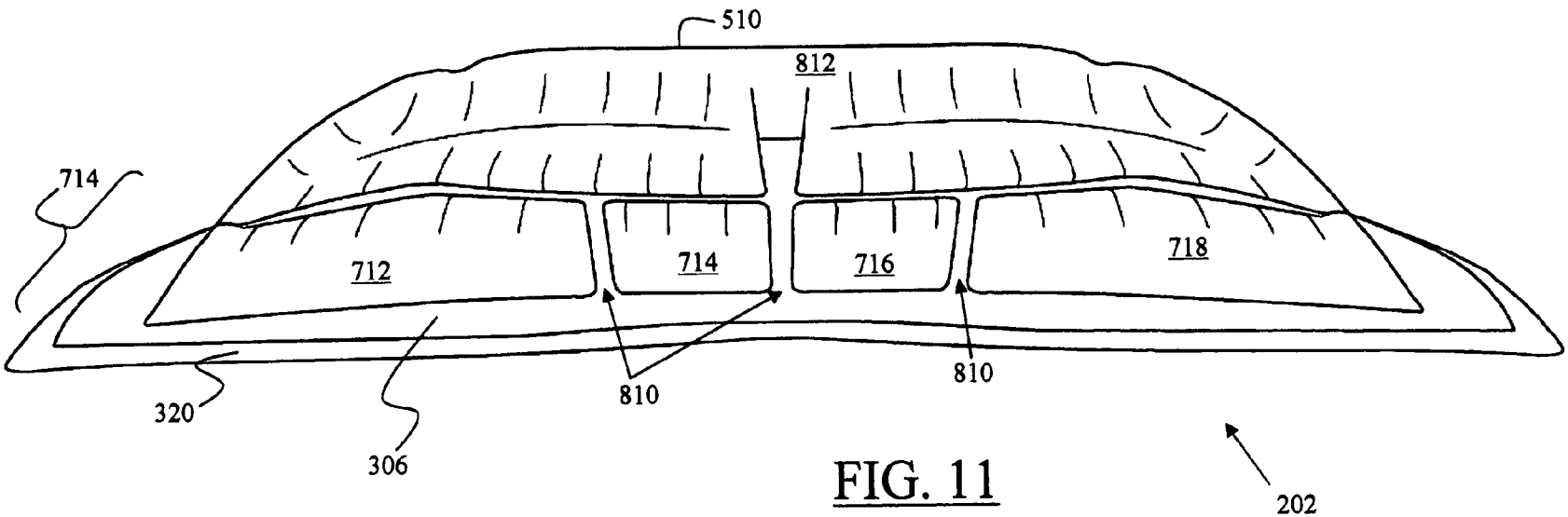
FIG. 11 is an exemplary bottom view illustration of the torso wedge in accordance with the present invention.

The bottom portion 704 of the frontal section of the torso wedge 202 is lower in gradient than the middle portion 702, with decreasing concavity (vertical 500-502 and lateral 504-506) in relation to the middle portion 702 for better distribution of abdominal mass of the user 100 across the hard surface 102. The lateral sections of bottom portion 704 of the frontal section of the torso wedge 202 includes the lower sections of the arched main support 510, which are substantially flat, and have a height that is lower than the apex at the top portion 308, and continue to vary commensurate with the gradient of the frontal section. The bottom portion 704 is substantially flat, with slight vertical 500-502 and lateral 504-506 incurvate. The bottom portion 704 includes a plurality of lower protuberances 712, 714, 716, and 718, forming a cushion of support between the abdominal section of the user 100 and the board 102. As best illustrated in FIG. 11, each of the lower protuberances 712, 714, 716, and 718 are separated by grooves or channels 810 at their respective three sides, and end at the hem 306.

Figure 12B:
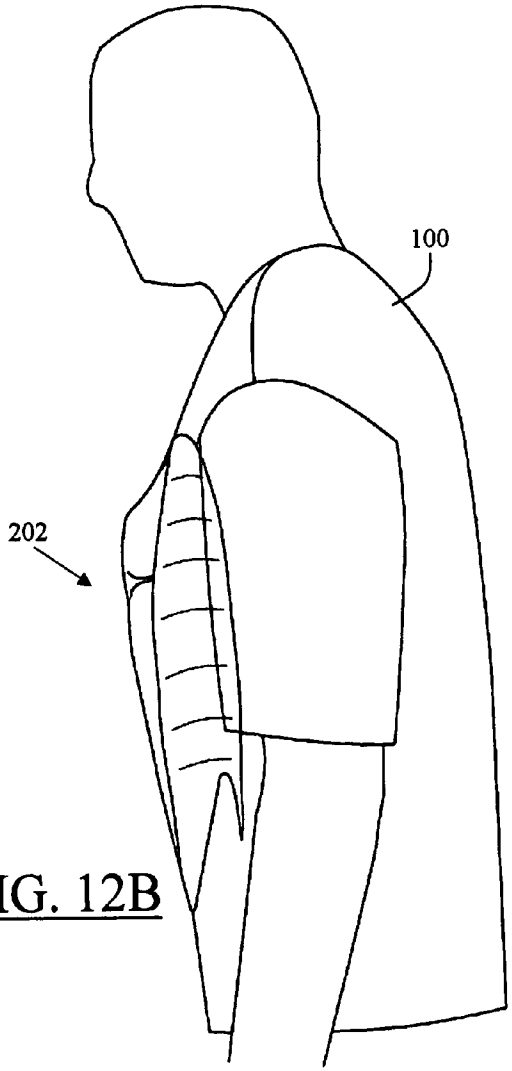
FIGS. 12A and 12B are exemplary illustrations of the torso wedge, detailing the backside thereof in accordance with the present invention.
Figure 12A:
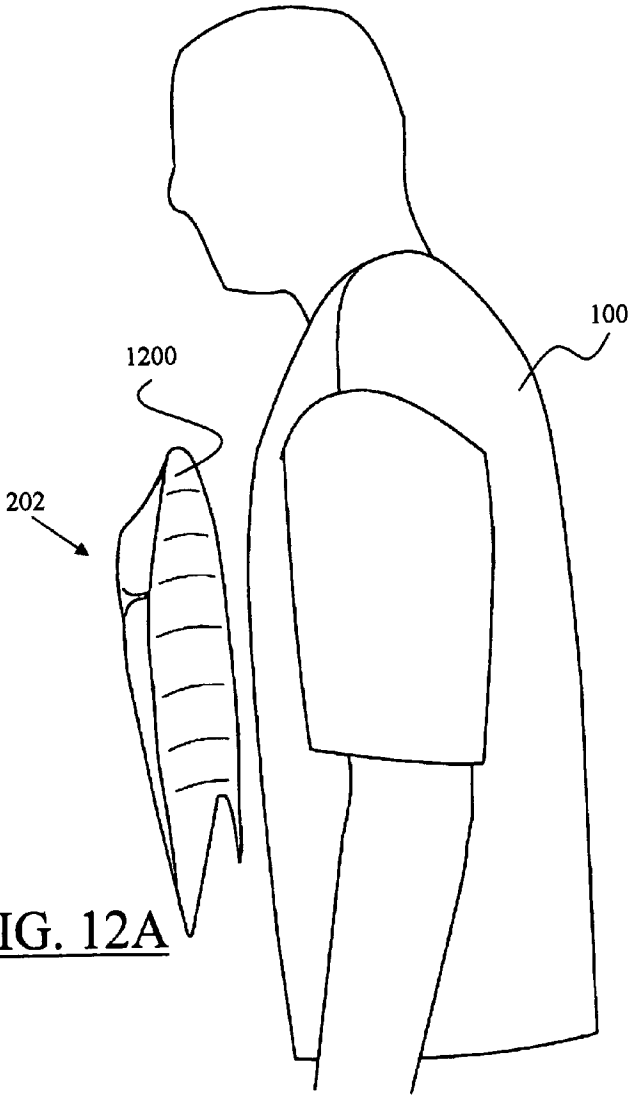
Figure 13B:
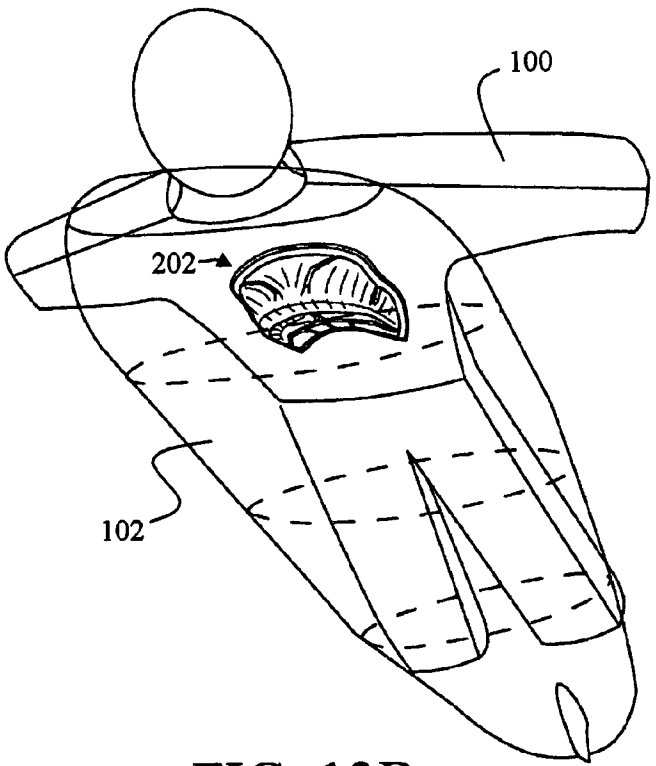
FIGS. 13A and 13B are exemplary perspective schematic illustrations of the user in prone position, in relation to an exemplary board while wearing a torso wedge in accordance with the present invention.
Figure 13A:
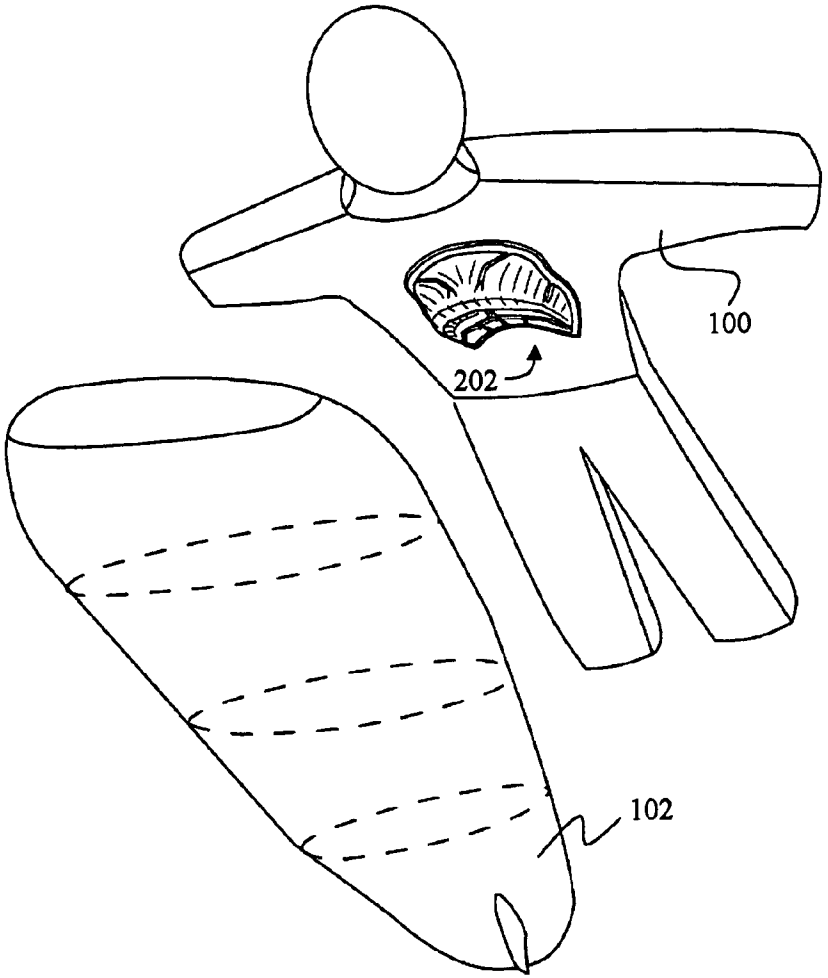
Figure 14:
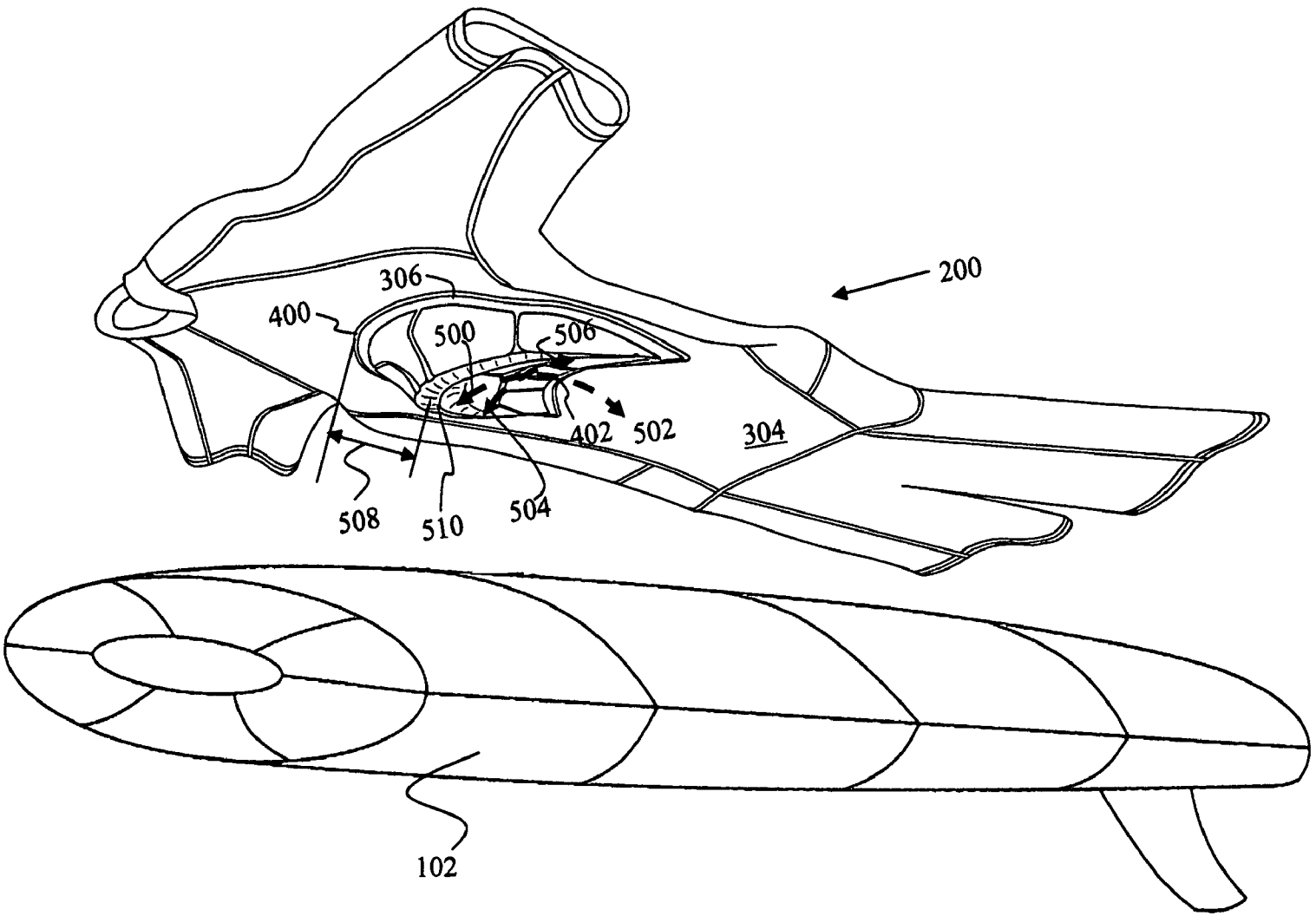
FIG. 14 is an exemplary perspective illustration of a wetsuit comprising a torso wedge in prone position in relation to a board in accordance with the present invention.
Figure 15A:
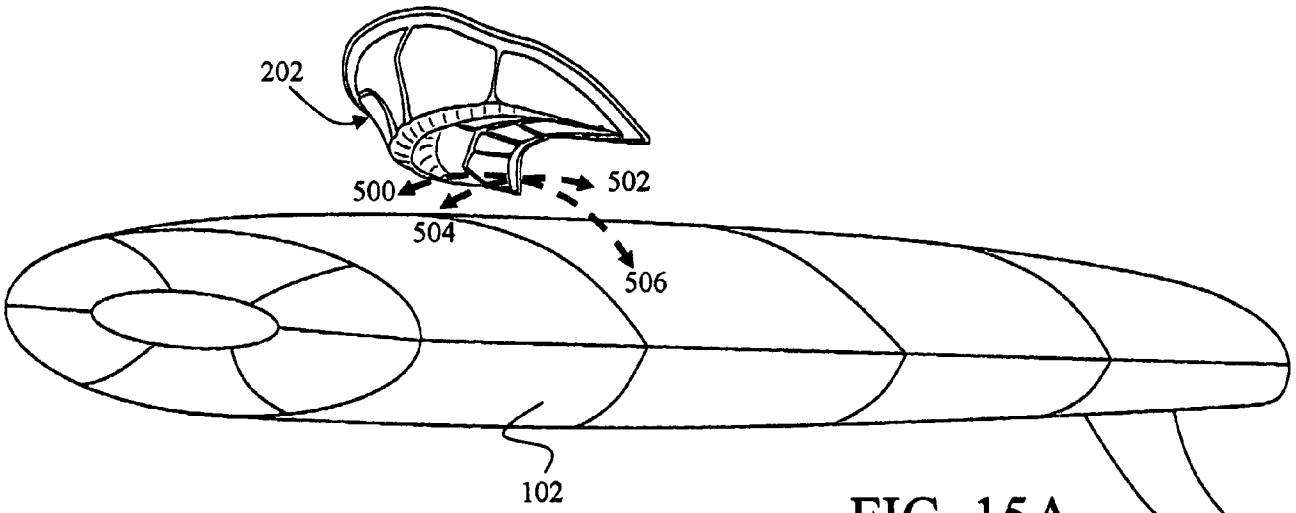
FIGS. 15A and 15B are exemplary illustrations of the torso wedge in relation to a board, particularly illustrating incurvate sections of the torso wedge in relation to the convex curvature of a surface area of the board in accordance with the present invention.
Figure 15B:
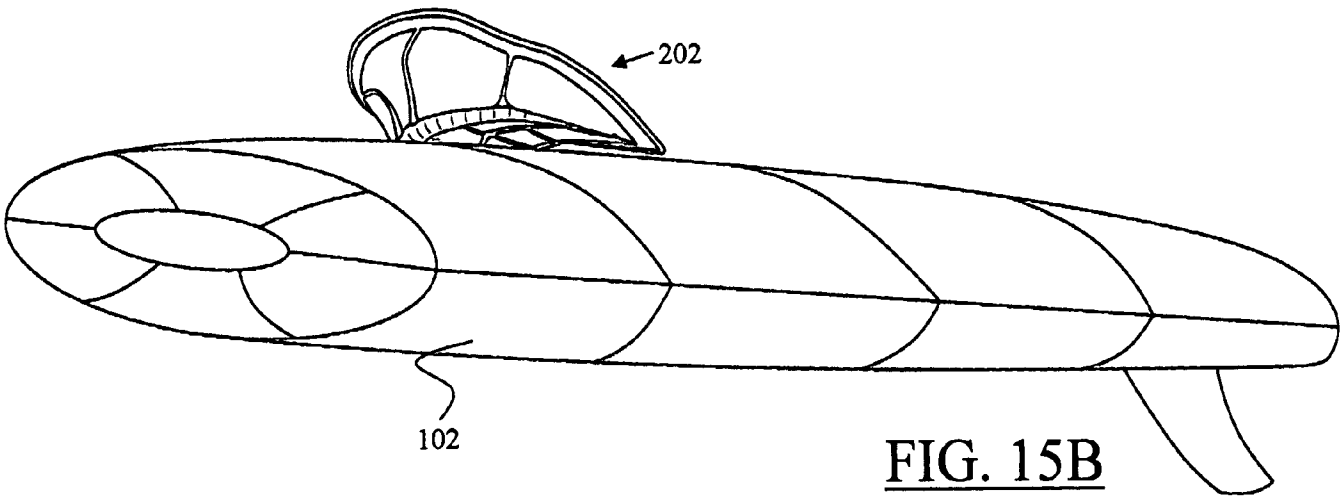
Figure 16A:
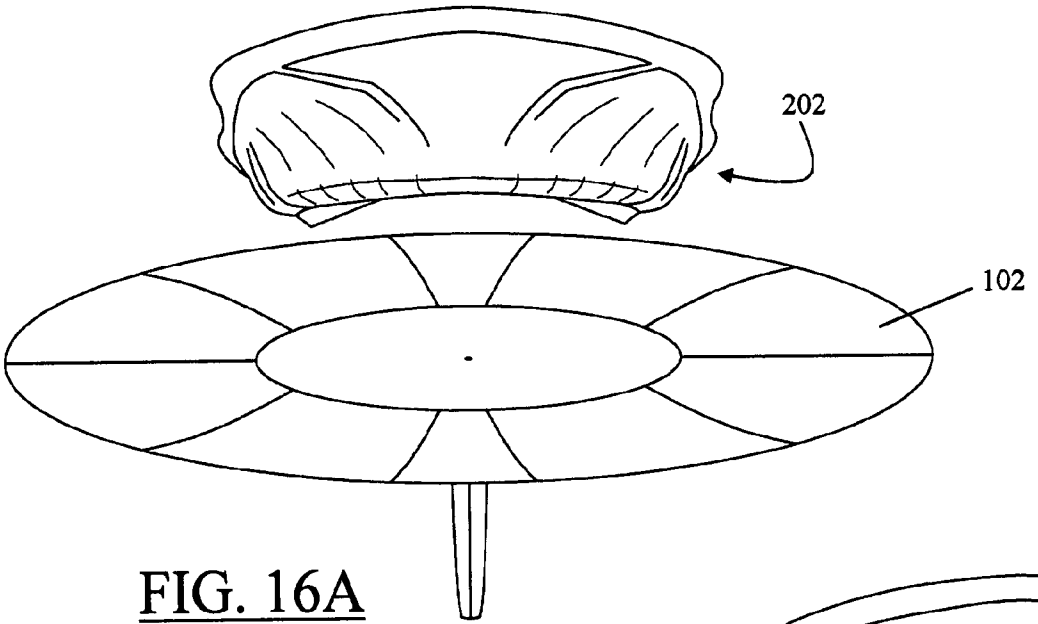
FIGS. 16A and 16B are exemplary illustrations of the torso wedge in relation to a board in accordance with the present invention, illustrating a frontal view.
Figure 16B:
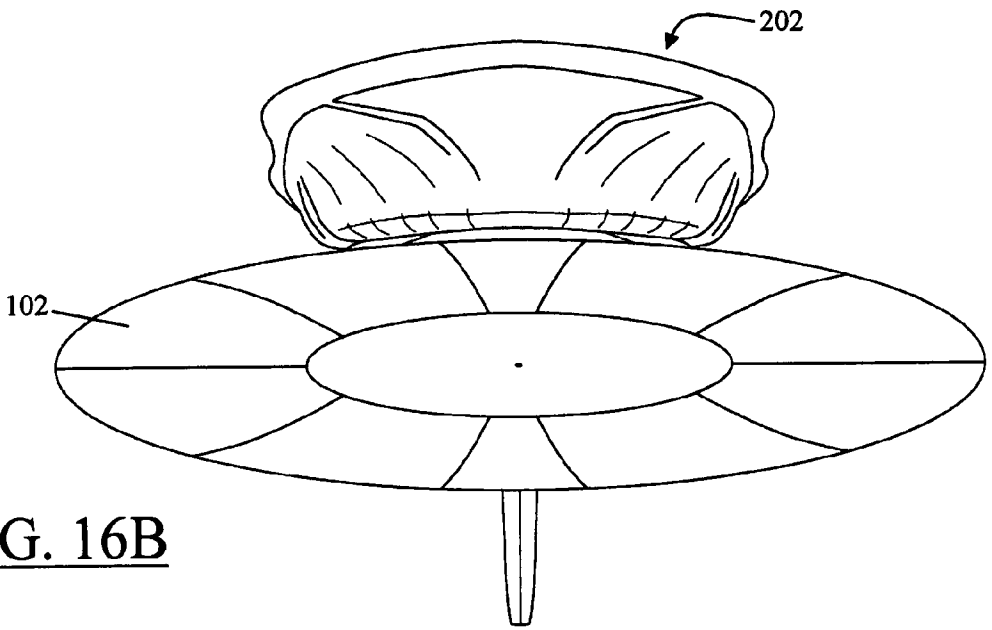

FIGS. 12A and 12B are exemplary illustrations of the torso wedge 202, detailing the backside 1200 thereof. As illustrated, the backside 1200 of the torso wedge 202 is smooth, and is concaved. That is, the backside 1200 is commensurately contoured in relation to a convex middle section of the user 100 to absorb pressure of the weight of the user 100 when in a prone position. FIGS. 13A and 13B are exemplary perspective schematic illustrations of the user 100 in prone position, in relation to an exemplary surfboard 102 while wearing the torso wedge 202 and FIG. 14 is an exemplary perspective illustration of the wetsuit 200 comprising the torso wedge 202 in prone position in relation to the surfboard 102. FIGS. 15A and 15B are exemplary illustrations of the torso wedge 202 in relation to the surfboard 102, particularly illustrating the vertical 500-502 and lateral 504-506 incurvate section of the torso wedge 202 in relation to the convex curvature of the surface area of the surfboard 102, with FIGS. 16A and 16B illustrating the same, via a frontal view. As illustrated in FIGS. 15A to 16B, the incuvate section of the torso wedge 202 is generally made to rest against (enfold or wrap around) the convex curvature of surface of the surfboard 102. This adds comfort, and prevents slippage of the user from the top surface of the board.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. For example, the size and dimensions of the torso wedge may be varied in accordance with the size of the user. Such variations and alternate embodiments are contemplated, and can be made without departing from the spirit and scope of the invention. Please note, the labels such as left, right, front, back, top, bottom, forward, reverse, clockwise, counter clockwise, or other similar terms such as aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

What is claimed is:

1. A wetsuit, comprising:

a garment, having:

a torso wedge having a backside, a frontal section having top, middle, and bottom portions, and raised side-walls for torso support when worn in a prone position on a hard surface;

the backside of the torso wedge is concaved and commensurately contoured to absorb pressure from a curved middle section of a user in a prone position;

the frontal section of the torso wedge is elevated having a varying gradient that is reduced from the top portion to the bottom portion of the frontal section, and is further concaved throughout the gradient from top to bottom, and laterally, thereof;

the top portion of the frontal section of the torso wedge is comprised of an arched apex plateau that conforms, supports, and spans a proximal width of a costal arch of the user's lower rib cage, elevating a torso of the user when in the prone position on the hard surface to reduce user upper and lower back exertion;

the middle portion of the frontal section of the torso wedge is lower in gradient than the top portion, with increased concavity in relation to the top portion for better distribution of the user's mass across the hard surface;

the bottom portion of the frontal section of the torso wedge is lower in gradient than the middle portion, with decreasing concavity in relation to the middle portion for better distribution of abdominal mass of the user across the hard surface; and the side walls of the torso wedge are comprised of concaved, slanted edges having varying heights that vary commensurate with the gradient of the frontal section, and a side wall top integral with the arched apex plateau of the top portion.

2. A wetsuit as set forth in claim 1, wherein:

the torso wedge is coupled with the garment by coupling a hem of the torso wedge with the garment.

3. A wetsuit as set forth in claim 2, wherein:

the hem of the torso wedge is comprised of a semicircle at the top portion, a reverse "V" arch configuration at the bottom portion, and angular slanting sides coupling the top portion with the bottom portion.

4. A wetsuit as set forth in claim 1, wherein:

the torso wedge is comprised of a sole, single piece unit.

5. A wetsuit as set forth in claim 1, wherein:

the torso wedge is comprised of a plurality of water and flexibility channels throughout the frontal section thereof.

6. A wetsuit as set forth in claim 1, wherein:

the torso wedge is comprised of an Ethylene Vinyl Acetate (EVA) foam covered by a wetsuit composite comprised of neoprene.

7. A wetsuit as set forth in claim 1, wherein:

the torso wedge is comprised of an Ethylene Vinyl Acetate (EVA) foam covered by a wetsuit composite comprised of Lycra.

8. A wetsuit as set forth in claim 1, wherein:

the torso wedge is comprised of an Ethylene Vinyl Acetate (EVA) foam covered by a wetsuit composite comprised of neoprene and Lycra.

* * * * *